United States Patent [19]

Keahey et al.

[11] Patent Number: 4,593,452

[45] Date of Patent: Jun. 10, 1986

[54] ROBOTIC HARNESS MAKER

[75] Inventors: Sammie G. Keahey, Landenberg; Alan S. Keizer, Mt. Gretna; Thomas T. Lobb, Lansdale, all of Pa.

[73] Assignee: AMP Incorporated, Harrisburg, Pa.

[21] Appl. No.: 705,596

[22] Filed: Feb. 26, 1985

[51] Int. Cl.[4] ..... H01R 43/00; B21F 27/00

[52] U.S. Cl. ..... 29/564.6; 29/564.8; 29/755; 29/857; 140/92.1; 140/93 R

[58] Field of Search ..... 29/564.4, 564.8, 564.1, 29/33 M, 564.6, 566.2, 56.6, 755, 748, 749, 850, 863, 747, 857, 867; 140/92.1, 93 R

[56] References Cited

U.S. PATENT DOCUMENTS

| | | | |
|---|---|---|---|
| 3,693,228 | 9/1972 | Logan | 29/755 |
| 3,845,535 | 11/1974 | Over | 29/749 X |
| 3,859,724 | 1/1975 | Folkenroth | 29/867 |
| 3,930,524 | 1/1976 | Tarbox | 29/755 |
| 3,947,943 | 4/1976 | Kokubo et al. | 29/755 |
| 4,030,527 | 6/1977 | Roch | 29/755 |
| 4,114,014 | 9/1978 | Shogo | 29/564.4 |
| 4,194,276 | 3/1980 | Grubb | 29/56.6 |
| 4,348,805 | 9/1982 | Gibbons | 29/564.6 |
| 4,476,629 | 10/1984 | Suzuki et al. | 29/863 |

*Primary Examiner*—William R. Briggs

*Attorney, Agent, or Firm*—F. Brice Faller

[57] ABSTRACT

Apparatus for manufacturing wiring harnesses employs a robot mounted above a harness board with storage areas for jigs, connectors, wire dispensers, and insertion tooling about the periphery thereof for easy pickup by robotic gripper, which positions jigs and connectors and laces wire from a wire dispensing assembly through the jigs before terminating and severing wire. Dispensing assembly comprises a dispenser which gripper picks up from a bracket in a holder to draw wire from endless source to lace the harness. The holder has wire feed wheels and a severing mechanism therein which may be used with a choice of dispensers in order to use different color or size wire. After termination and severing, pivoted platforms on wire jigs eject wire scraps from around lacing posts fixed on the jigs.

8 Claims, 10 Drawing Figures

84
25
83
73
72
13
12
70
80
78
79
81
75
76
25
116
86
6
6
86
74
91
104
90
94
102
100
95
103
112
110
113
108
106
107
111
92

ROBOTIC HARNESS MAKER

BACKGROUND OF THE INVENTION

The present invention relates to apparatus employing a robot in the manufacture of a wiring harness.

U.S. Pat. No. 3,859,724 describes harness making apparatus for manufacturing wiring harnesses of the type comprising a plurality of multicontact connectors having terminals therein and wires extending between the connectors and connected to the terminals. The apparatus comprises a harness board, a plurality of wire and connector jigs which are mountable on the board at locations corresponding to the positions of the connectors in the completed harness. Each jig has connector holding means and wire locating means for locating wires adjacent to the terminals in a connector held in the jig. A connecting tool cooperable in turn with each of the jigs is effective to connect the wires in the wire locating means in each jig to the terminals in the connector in the jig.

The above-described apparatus is directed to terminating wires to connectors of the type described in U.S. Pat. No. 4,159,158 and more generally to any connectors having insulation displacing contacts with which wires are aligned in the jigs. The jigs are suitably of the type described in U.S. Pat. No. 4,194,276 and connecting tool suitably of the type described in U.S. Pat. No. 3,845,535.

The above described apparatus makes no provision for lacing the wire through the jigs in alignment with the desired contact terminals. Rather, the wires are laced manually which is not only time-consuming but subject to human error. Accordingly, it would be desirable to automate the lacing procedure.

SUMMARY OF THE INVENTION

According to the present invention, harness making apparatus as described above further comprises a programmed robot having gripping means positioned above the board and movable in the XYZ directions with respect to the board. A portable wire dispensing assembly adapted for handling by the robotic gripping means is provided. The robot is programmed to move the wire dispensing assembly along a predetermined path to locate the wire while the wire is dispensed from an endless source.

The preferred dispensing assembly comprises a wire dispenser having guide means receiving wire therethrough. The dispenser is received in a passage in a holder having wire feed wheels, a placement head for locating wire, and a wire severing mechanism.

The jigs, connectors, wire dispensing assemblies, and connecting tool are located at storage locations immediately adjacent to the board for pickup by the robotic gripping means. Use of more than one dispenser permits the robot to lace different wire colors or gages through the jigs without the necessity of changing wires in a dispenser. In the preferred embodiment, this is facilitated by use of several simple dispensers at discrete storage locations. The robotic gripping means handles a single wire holder, the robot being programmed to pick up the desired dispenser in the holder, and to return it to its storage location when finished.

BRIEF DESCRIPTION OF THE DRAWINGS

FIG. 3 is a perspective of a connector holding and wire locating jig.

DETAILED DESCRIPTION OF THE PREFERRED EMBODIMENT

Figure 1:
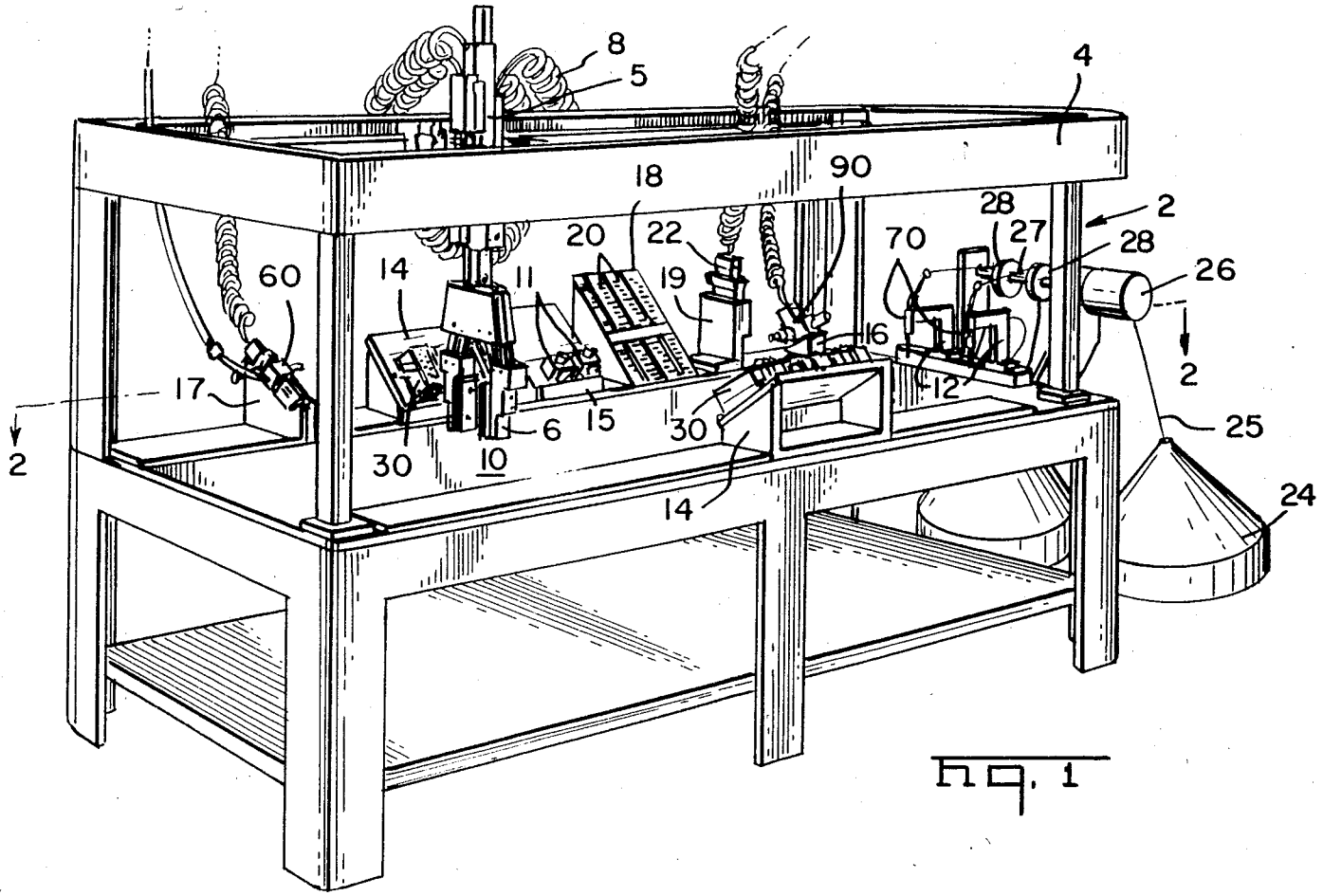
FIG. 1 is a perspective of the harness making apparatus.

Referring to FIG. 1, a harness board 10 is disposed horizontally in a generally rectangular frame 2 having upper rails 4 which carry a robotic manipulator 5 therein. The preferred robot is an IBM RS 1 Manufacturing System, which comprises, in addition to the frame 2 and manipulator 5, a controller which is not shown. The manipulator 5 uses the upper rails to support an arm with wrist and two-finger gripper 6. There are three linear movements corresponding to the X, Y and Z movements of the arm and three rotary motions corresponding to the roll, pitch and yaw of the wrist, plus the controlled gripping and releasing motion of the gripper fingers. The gripper fingers remain essentially parallel so that various objects can be grasped squarely and firmly. Movements are controlled hydraulically by lines 8.

Storage areas situated about the periphery of the harness board 10 include a rack 19 for bundler 22, racks 14 for jigs 30, a rack 15 for lacing pegs 22, a rack 18 for connectors 20, a rack 17 for insertion tool 60, a rack 16 for dispenser holder 90, and brackets 12 for wire dispensers 70. Each dispenser 70 has insulated electrical wire 25 threaded therethrough, the wire being supplied from drums 24 over capstans 28 driven by electric motor 26.

Figure 2:
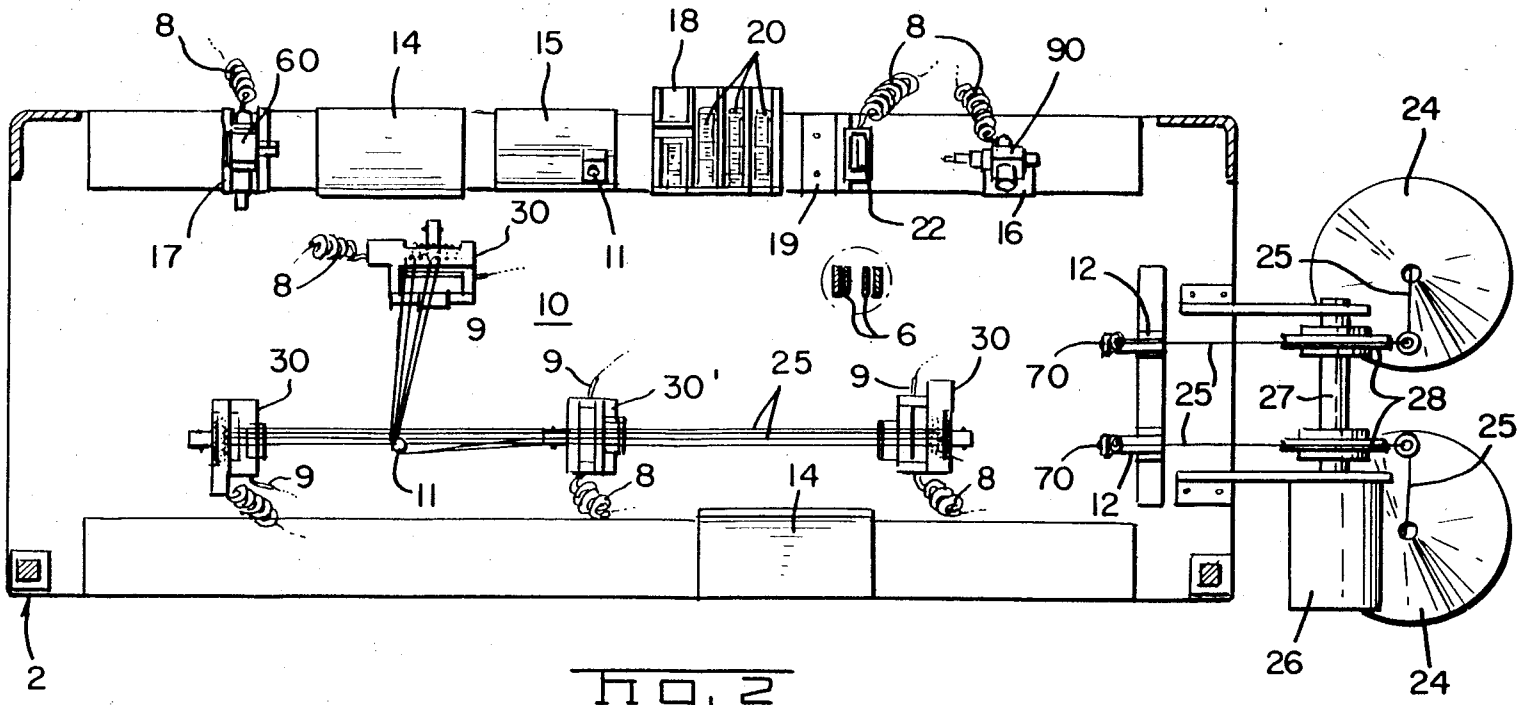
FIG. 2 is a plan view of the harness board and storage locations.

FIG. 2 is a plan view of the harness board 10 with gripper 6 shown in section thereabove. Jigs 30, 30' have been placed on the board by gripper 6 and are held down by vacuum supplied by lines 9 as will be described in conjunction with FIG. 5. Connectors 20 are located in the jigs 30, 30' and wires 25 thereafter are laced through the jigs in alignment with individual contact terminals. The dispenser holder 90 is used with either wire dispenser 70, the combination forming a wire dispensing assembly handled by gripper 6 to lace wire 25 through jigs 30, 30' according to the procedure described in U.S. Pat. No. 3,859,724, which is hereby incorporated by reference. Capstan pulleys 28 are fixed on shaft 27, which is driven continuously so that only slight tension provided on wire 25 by moving the dispensers 70 will cause wire to be fed thereto. The jigs 30 are for end termination while jig 30' is for through-wire application; the post 11, held down by a magnet actuated by the gripper 6, is used to route wire 25. After lacing is completed, the dispenser 70 is replaced and the grippers 6 pick up insertion tool 90 to insert and cut wires. The tool 90 is of the type described in U.S. Pat. No. 3,845,535. Subsequent to termination, wire scraps are ejected from the jigs and the gripper 6 picks up bundler 22 which applies nylon bundling straps to wires 25 between jigs 30, 30' before releasing connectors therefrom and removing the completed harness.

Figure 4:
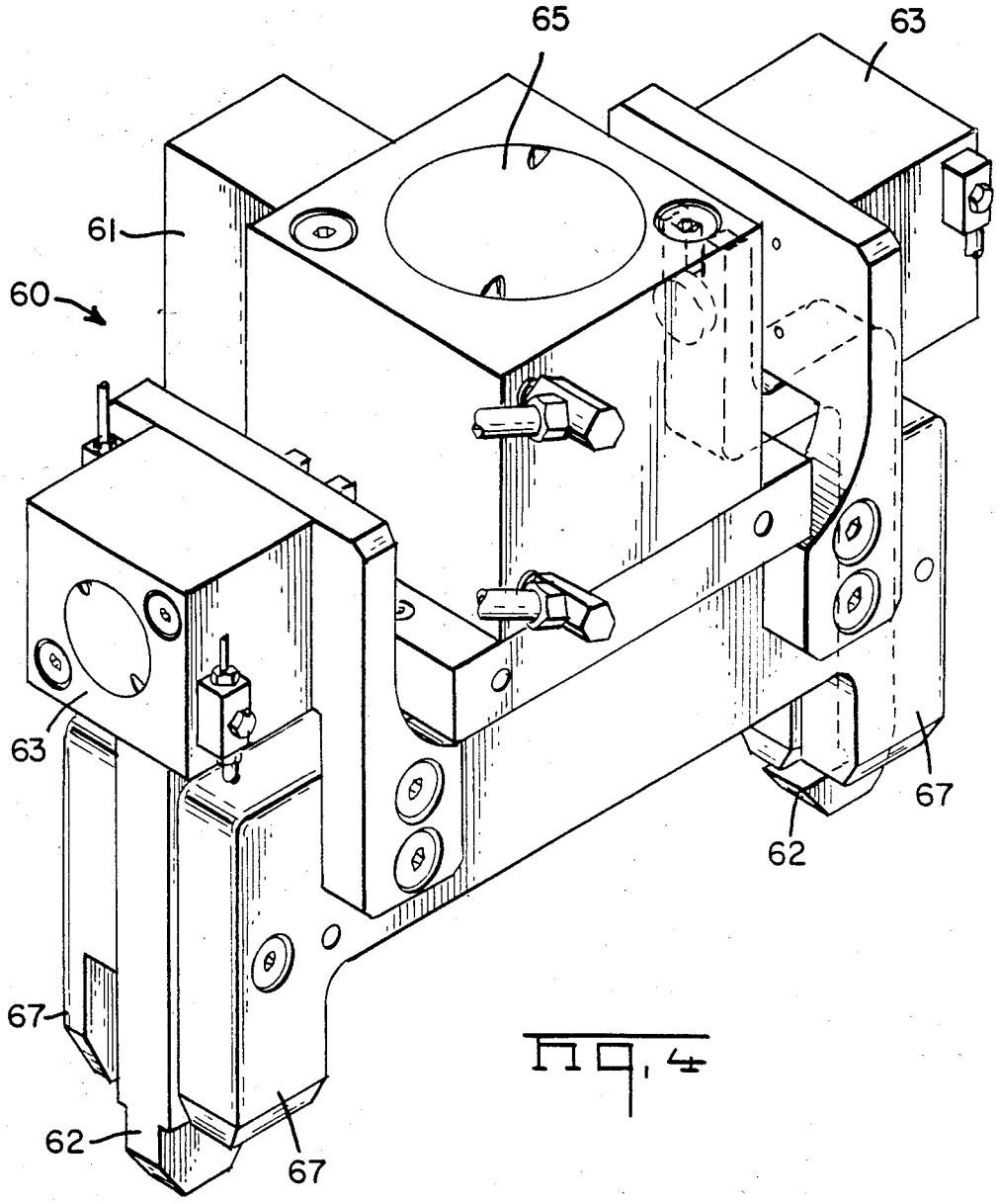
FIG. 4 is a perspective of the wire insertion tool.
Figures 8, 8A:
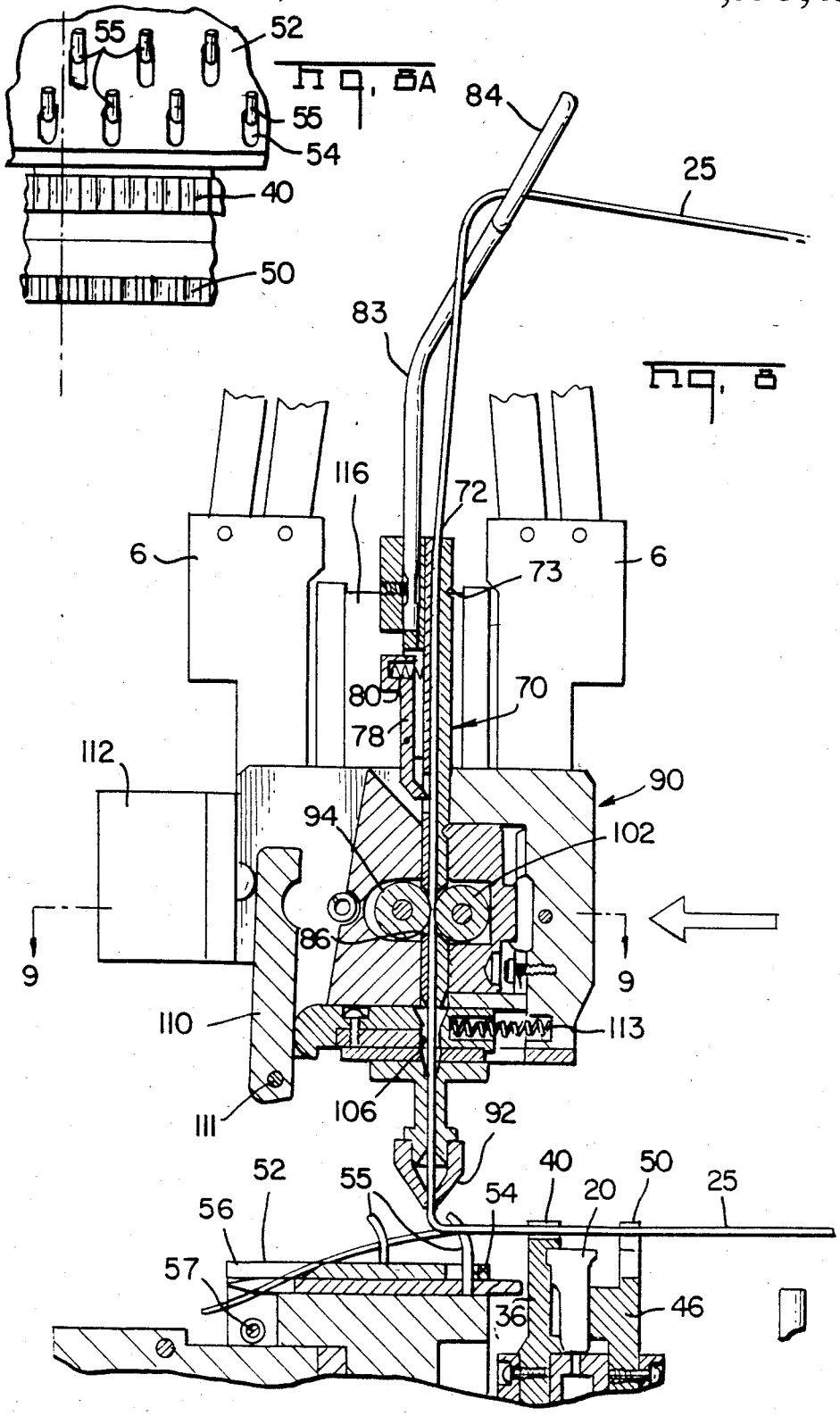
FIG. 8 is a section view of the dispenser in its holder as wire is laced through a jig.
FIG. 8A is a plan view of the offset relationship of the lacing posts and jig slots.

FIG. 3 depicts a jig 30 designed especially for use in a robotic harness manufacturing system, and represents an improvement over the jig described in U.S. Pat. No. 4,194,276. Endwalls 35 are fixed to base 32 and carry pivot shafts 47, 57 which permit first and second clamping plates 36, 46 to pivot apart to receive a connector therebetween. Wire slots 40, 50 in the tops of plates 36, 46 serve to align wires with terminals in the connector. Platform 52 has V-slots 56 in one edge thereof which serve as initial anchoring point for wire 25 being dispensed from the dispensing assembly (FIG. 8). Thereafter the wire can be drawn rather than fed, as will be described. Latching lugs 44 serve as anchors for the insertion tool 60 as will be described (FIG. 4). Lacing posts 55 are fixed relative to base 32 and serve as looping points for wire being drawn back through slots 40, 50. The posts 55 upstand through slots 54 in platform 52, which pivots about shaft 57 to eject wire scraps when air cylinder 58 is actuated. Referring also to FIG. 8A, note that each lacing post 55 is offset from the centerline through a pair of opposed slots 40, 50 one half the distance between slots in each plate. There are two rows of posts 55, the posts in each row being at twice the slot centerline spacing, so that the posts collectively are spaced as the slots on either side of the centerlines thereof. A jig 30' (FIG. 1) is similar to jig 30 but does not have the lacing post and ejecting platform features.

FIG. 4 depicts insertion tool 60 of the general type disclosed in U.S. Pat. No. 3,845,535, adapted for robotic handling. Gripping block 61 is gripped by the gripper 6 (FIG. 1) and mechanisms are actuated pneumatically. Latch arms 62, actuated by air cylinders 63, serve to anchor the tool 60 to lugs 44 on jigs 30, 30', whereafter two-way hydraulic 64 is actuated to terminate and sever wires (FIG. 5).

Figure 5:
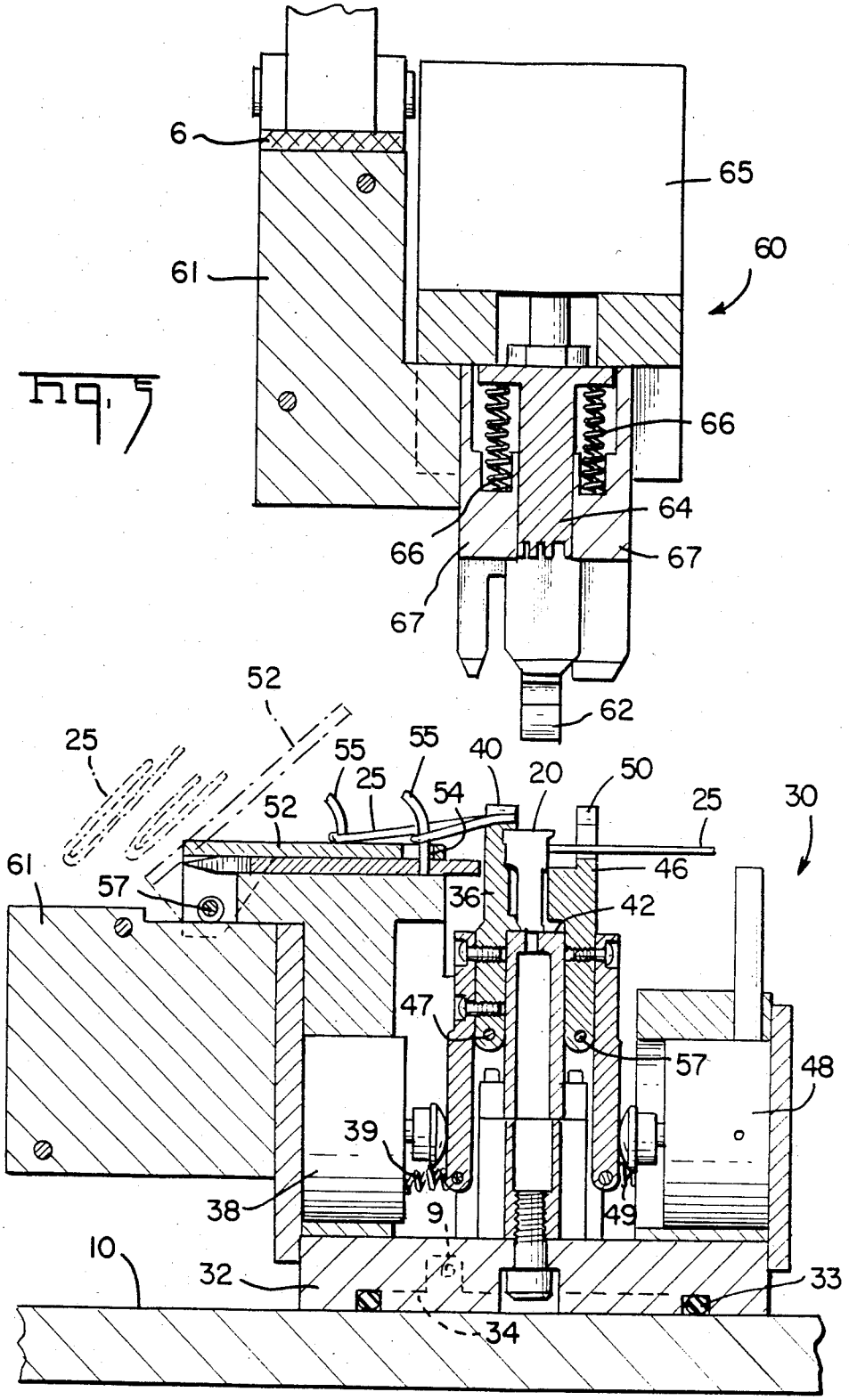
FIG. 5 is a section view of the jig with the insertion tool poised above.

FIG. 5 shows a connector 20 in place on pedestal 42 between clamping plates 36, 46, which pivot about shafts 37, 47 respectively when actuated by air cylinders 38, 48 to receive the connector 20. The plates 36, 46 are held against the connector 20 by springs 39, 49 opposite the pivot shafts. The insertion head 64 has just inserted wires 25 into connector 20, severing the ends lying in slots 40 against the bottoms of the first plate 36. Fingers 67 serve to hold the wires 25 in slots 40, 50 during insertion, the fingers being loaded resiliently against the wires by springs 66. Note that the tool 60, held by grippers 6, does not move vertically during insertion. Rather, the latch arms 62 anchor it to the jig 30 and the air cylinder 65 moves the inserters 64. After insertion, the platform 52 is pivoted to eject the wire scraps as shown in phantom.

The precise positioning of the jig 30 is important to assure that the inserters 64 will terminate the wires without damaging the connector 20. To achieve this, the grippers 6 "check" the position of the jig 30 after placing it on the harness board 10 and provide feedback on its precise position to the controller, which determines the movements of the dispenser and inserter accordingly. After the "check", which is accomplished simply by moving the grippers toward the end of gripping block 61 until strain gages in the grippers 6 detect resistance, vacuum is applied to chamber 34, which is surrounded by O-ring 33 in base 32. The harness board 10 is machined steel and its surface is extremely smooth to aid in maintaining vacuum.

Figure 6:
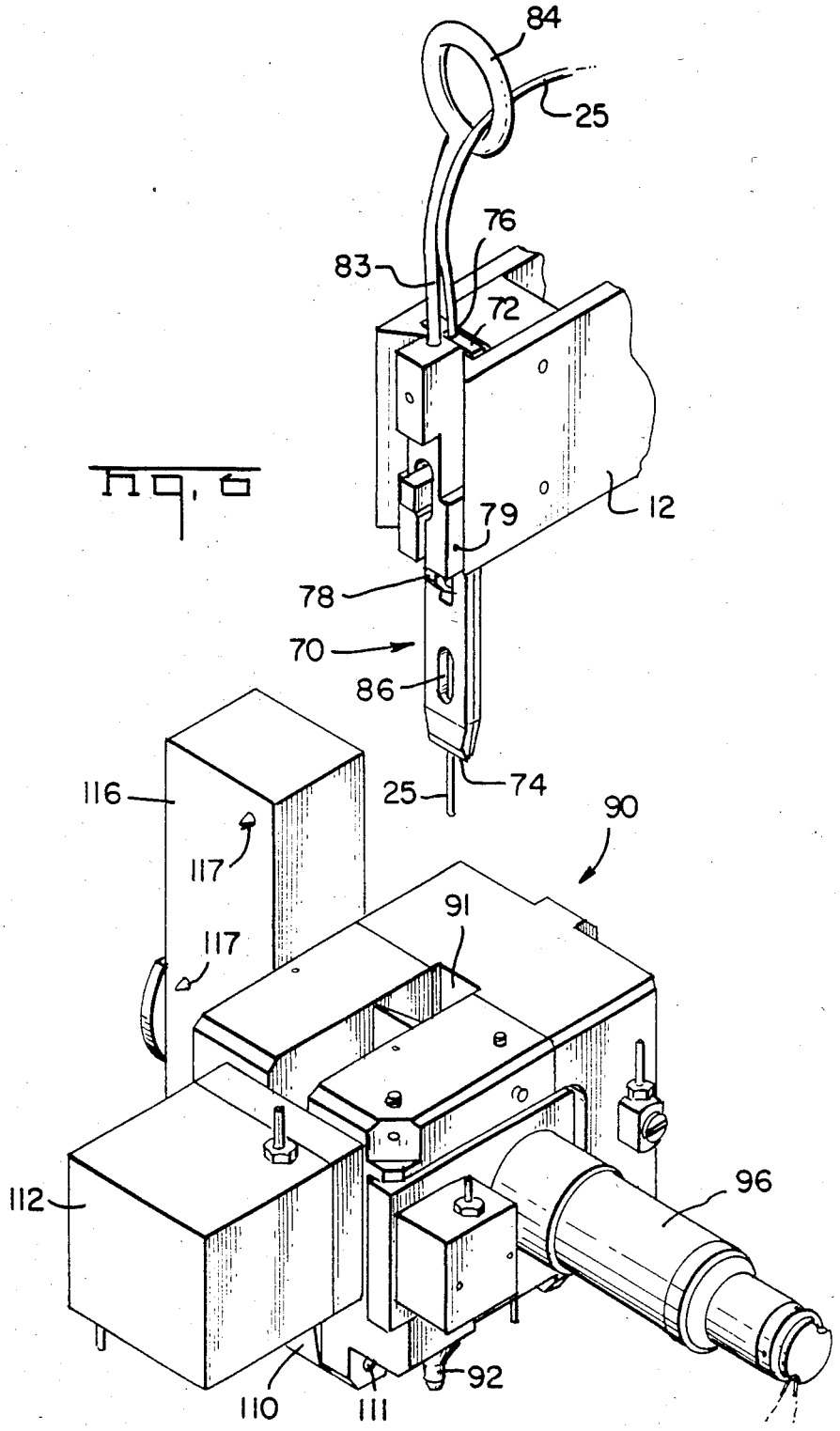
FIG. 6 is a perspective of the wire dispenser and dispenser holder.
Figure 7:
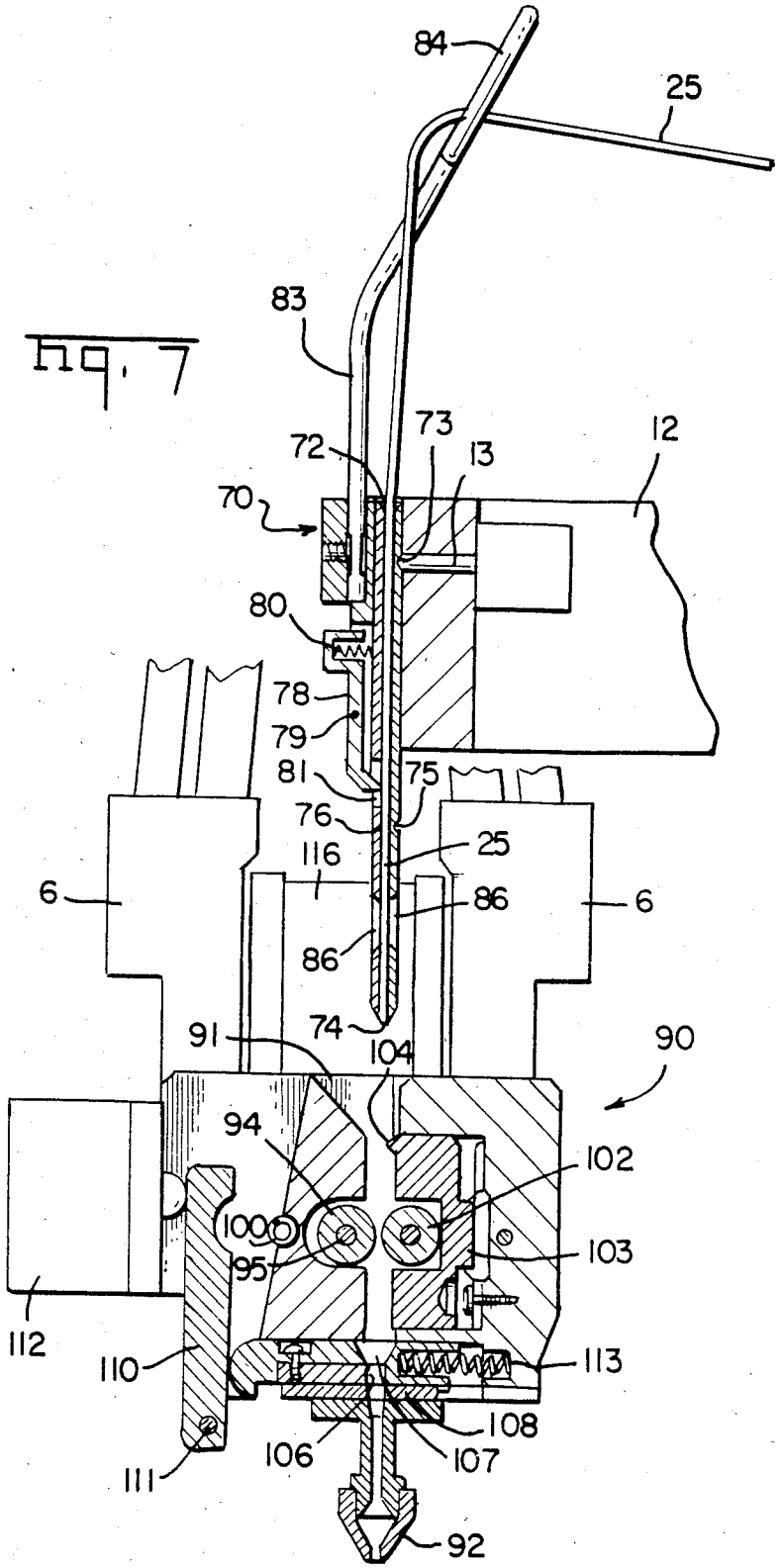

FIG. 6 depicts the wire dispensing assembly, which comprises a wire dispenser 70, shown in its bracket 12, and the dispenser holder 90 having an integral gripping block 116. The dispenser 70 has a first, wire receiving end 72 and a second, wire dispensing end 74 with wire guide means in the form of a tube-like passage 76 extending therebetween. A ferrule 84 disposed remotely from first end 72 on ferrule extension 83 guides the wire 25 on a generally straight path into guide 76 to minimize friction and prevent binding. The passage 76 receives wire 25 therethrough; a spring-loaded anti-backup finger 78 on pivot pin 79 prevents the wire from backing out. Drive apertures 86 provide access for wire feed wheels in the holder 90 as will be described. Conical pins 117 mate with conical recesses in the gripper fingers so that the robot can know the precise position of the wire 25. The dispenser 70 is closely received in passage 91 in the holder 90, and the wire 25 emerges from placement head 92 in the bottom thereof. Motor 96 serves to drive the feed wheels in the holder 90 and air cylinder 112 drives a wire severing mechanism.

Figure 7:
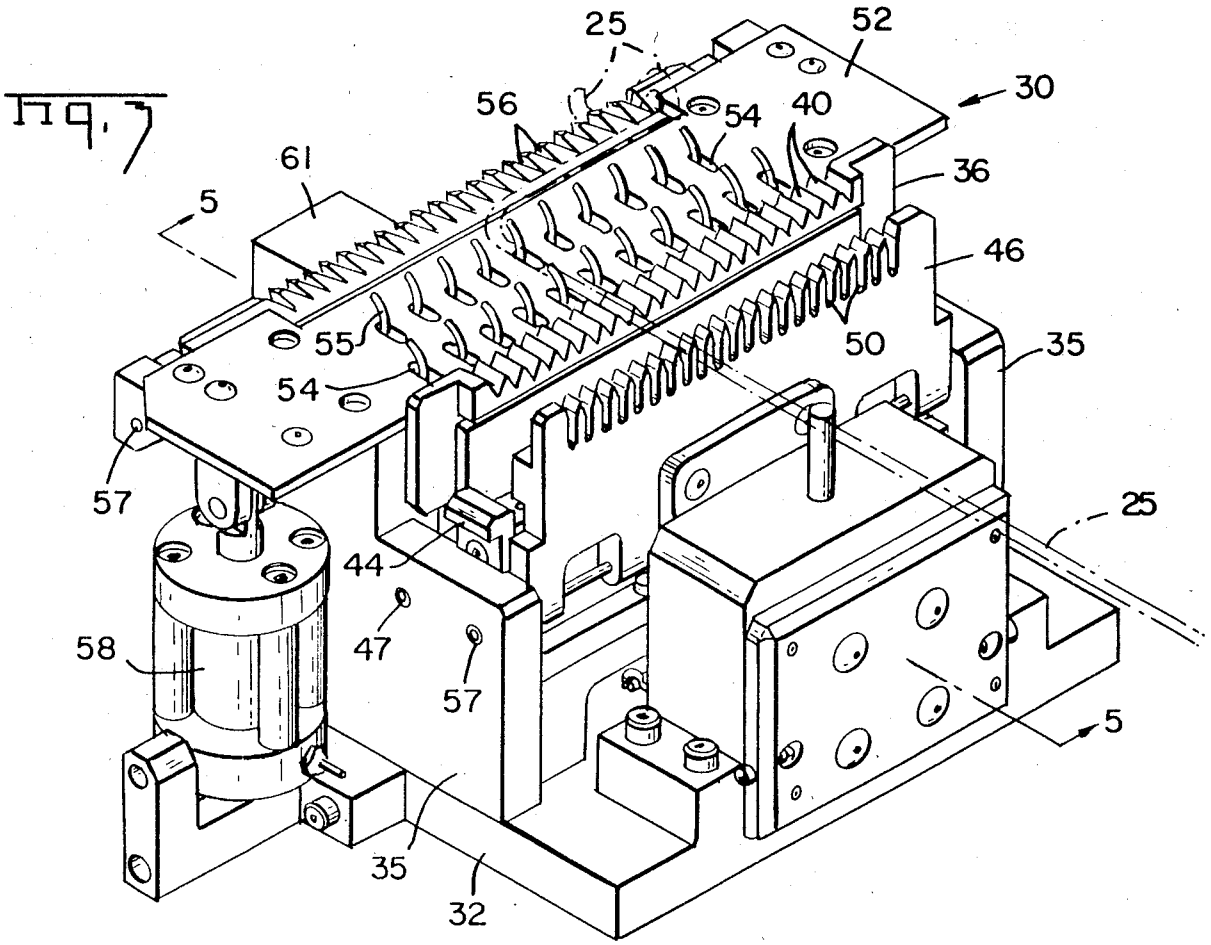
FIG. 7 is a section view of the dispenser holder as it approaches the dispenser on the dispenser bracket.
Figure 9:
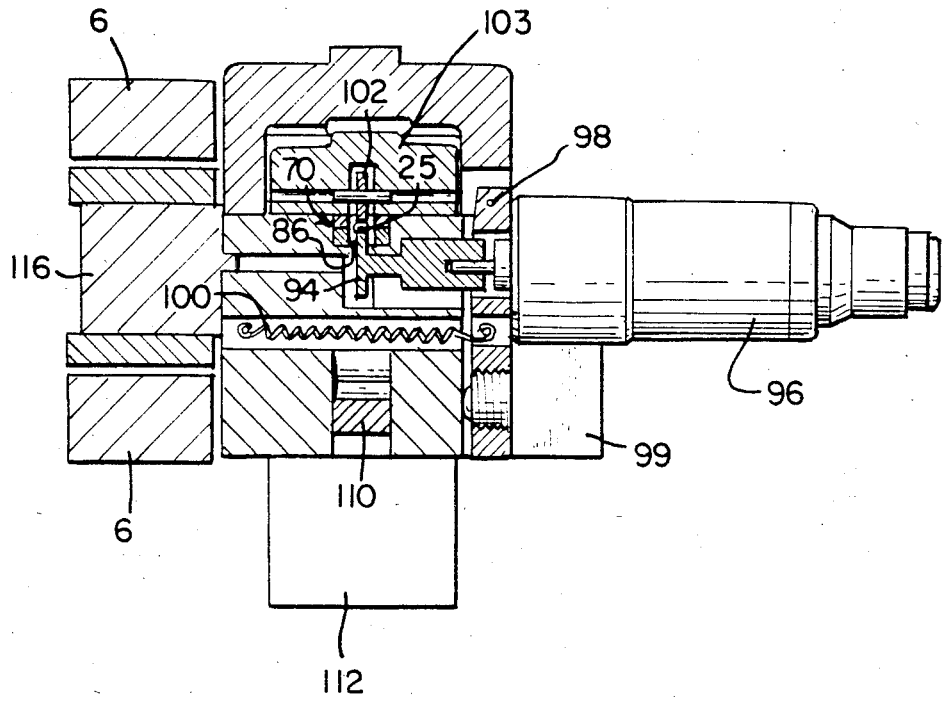
FIG. 9 is a section view taken along line 9—9 of FIG. 8.

FIG. 7 shows the holder 90, with gripping block 116 gripped firmly between grippers 6, just before it is moved vertically to receive wire dispenser 70 in passage 91. A spring-loaded pin 13 is seated in notch 73, and finger 78 is loaded against wire 25 by spring 80. As the dispenser 70 is received in passage 91, the feed wheels 94, 102 resile outwardly so that the wheels 94, 102 roll over the dispensing end 74 and are received in apertures 96. The wheel 94 on driven shaft 95 may also be pivoted outward pneumatically (FIG. 9). The wheel 102 is an idler journaled in carriage 103, which is spring-loaded toward passage 91 so that it resiles until detent 104 thereon is received in notch 75 in the dispenser 70. Air cylinder 112 is disposed to act on lever 110 pivoted on shaft 111, yielding good mechanical advantage against wire cutter 106 therebelow. The cutter 106 has an aperture 107 therein which shifts across aperture 108 therebelow to sever wire 25 passing through the apertures 107, 108 as shown in FIG. 8; the cutter 106 is returned by spring 113 when air pressure is released.

FIG. 8 shows the wire dispensing assembly 70, 90 as wire 25 is dispensed from placement head 92 and laced through slots 40, 50 to position it over desired terminals in connector 20. At the position shown, the wire 25 may be drawn rather than engaging it with feed wheels 94, 102. However, at the beginning of lacing when the assembly is moved from the dispenser bracket 12 (FIG. 7) to the first jig 30, it must be fed by driving wheel 94 until it is caught in a V-slot 56 in the edge of platform 52. Thereafter the wheel 94 may disengage the wire 25 so it can be strictly drawn. Since the posts 55 are offset from the centerlines of the slots 40, 50 (FIG. 8A), the wire may be drawn in a straight line through the slots and between the posts before being looped therearound and drawn back through the desired slots 40, 50.

FIG. 9 is a cross section of the wire dispensing assembly taken along line 9—9 of FIG. 8; the dispenser 70 is in place in passage 91 in holder 90, and the feed wheels 94, 102 engage the wire 25 through drive apertures 86 in dispenser 70. Drive motor 96 for the driven feed wheel 94 is pivotable anticlockwise about pivot 98 by pneumatic cylinder 99 to disengage the wire 25. Spring 100 returns the feed wheel 94 when air pressure is released.

The foregoing is exemplary and not intended to limit the scope of the claims which follow.

We claim:

1. A harness making apparatus for manufacturing harnesses of the type comprising a plurality of multicontact connectors having terminals therein and wires extending between the connectors and connected to the terminals, the apparatus being of the type comprising a harness board, a plurality of wire and connector jigs which are mountable on the board at locations corresponding to the positions of the connectors in the completed harness, each jig having connector holding means and wire locating means for locating wires adjacent to the terminals in a connector held in the jig, and a connecting tool cooperable in turn with each of the jigs and effective to connect the wires in the wire locating means in each jig to the terminals in the connector in the jig, the apparatus further comprising a programmed robot having gripping means positioned above the board and movable in the XYZ directions with respect to the board, and a wire dispensing assembly which is handled by the robotic gripping means, the robot being programmed to move the wire dispensing assembly along a predetermined path to locate the wire while wire is dispensed from an endless source, said assembly comprising a wire dispenser holder and a wire dispenser received therein, said wire dispenser having a first wire receiving end, a second wire dispensing end, and wire guide means extending between said ends, said dispenser receiving wire at said first end from said endless source and dispensing wire from said second end for placement in said jigs, said dispenser being elongate in form and being received in said holder with said second end toward said board, said guide means comprising tube means through said dispenser, said holder having a placement head with a passage therethrough which receives said wire therethrough from said second end of said dispenser and locates said wire in said jigs, said holder having a pair of wire feed wheels acting on wire in said tube means through apertures in opposed walls of said dispenser, said dispenser being thin in cross section between said feed wheels.

2. Apparatus as in claim 1 wherein one of said feed wheels is journaled on a pivotable shaft whereby said one of said wheels is moved toward the adjacent aperture, the other said wheel being spring-loaded toward the adjacent aperture.

3. Apparatus as in claim 2 wherein said one of said wheels is a driven wheel, the other wheel being an idler.

4. Apparatus as in claim 1 wherein said holder further carries cutting means effective to cut said wire between the second end of said dispenser and said placement head.

5. Apparatus as in claim 1 wherein said jigs comprise vacuum hold-down means for securing to said board, vacuum being provided to said hold-down means after said gripping means places said jigs on said board.

6. Harness making apparatus as in claim 1 wherein said dispenser further comprises ferrule means situate opposite said first end from said second end, said ferrule means guiding said wire therethrough from said endless source for substantially straight entry in said first end.

7. Apparatus as in claim 1 wherein said dispenser further comprises anti-backup means which acts on said wire to prevent backup from said second end to said first end.

8. Apparatus as in claim 1 wherein said anti-backup means comprises a spring-loaded finger which bears against said wire intermediate said ends.

* * * * *